United States Patent [19]

Covell et al.

[11] Patent Number: 4,545,330

[45] Date of Patent: Oct. 8, 1985

[54] SELF-CLEANING LINER

[75] Inventors: Russell B. Covell, Granby; Andrew F. Kwasnik, Ellington, both of Conn.

[73] Assignee: Cool Water Coal Gasification Program, Daggett, Calif.

[21] Appl. No.: 598,729

[22] Filed: Apr. 10, 1984

[51] Int. Cl.[4] ..... F22B 37/52; F22B 37/54

[52] U.S. Cl. ..... 122/392; 122/7 R; 122/6 A; 122/405

[58] Field of Search ..... 122/379, 390, 391, 392, 122/396, 405

[56] References Cited

U.S. PATENT DOCUMENTS

| | | | |
|---|---|---|---|
| 705,912 | 7/1902 | Eichelberger | 122/392 |
| 950,188 | 2/1910 | Parker | 122/405 |
| 1,152,423 | 9/1915 | Linaker | 122/392 |
| 1,640,137 | 8/1927 | Thomas | 122/392 |
| 2,001,889 | 5/1935 | Rash | 122/405 |
| 2,775,958 | 1/1957 | Kolling | 122/392 |
| 4,245,588 | 1/1981 | Gill et al. | 122/6 A |
| 4,273,076 | 6/1981 | Lahoda et al. | 122/405 |
| 4,372,253 | 2/1983 | Hibbel et al. | 122/392 |
| 4,377,132 | 3/1983 | Koog et al. | 122/7 R |

FOREIGN PATENT DOCUMENTS

| | | | |
|---|---|---|---|
| 412680 | 4/1925 | Fed. Rep. of Germany | 122/390 |

*Primary Examiner*—Henry C. Yuen

*Attorney, Agent, or Firm*—Lyon & Lyon

[57] ABSTRACT

A self-cleaning liner for high pressure boilers. The self-cleaning liner comprising a tubular liner and a sprayhead assembly. To minimize thermal shock, the sprayhead assembly protrudes into a cavity created by the formation of a bump in the tubular liner, shielding the sprayhead assembly from high temperatures. The sprayhead assembly may also incorporate a thermal sleeve to decrease thermal shock caused by the temperature difference between the sprayhead assembly and the cleaning medium.

13 Claims, 5 Drawing Figures

SELF-CLEANING LINER

BACKGROUND OF THE INVENTION

The present invention is in the field of self-cleaning liners for boilers. More specifically, the invention is directed to a self-cleaning liner, having a thermal protection for a thermal shock resistant sprayhead assembly, capable of spraying either a liquid or a gas, for use in boilers.

In the coal gasification processes a coal slurry is burned in a gasifier. As the coal slurry is burned, it produces a syngas, and quantities of soot, ash, and slag. The syngas and residue is transferred from the gasifier to high pressure boilers which cool the syngas. These boilers generally consist of an outer vessel and an inner tubular liner. The tubular liners in the boilers used in the coal gasification process serve several purposes: they cool the coal gas; they protect the outer vessel walls of the boiler; and, they generate steam. The tubular liners are constructed of a series of tubes joined together by web or fin members such that a cylindrical continuous surface results. Due to this manner of construction the tubular liner has a ribbed contour. As the syngas is passed through the high pressure boilers the soot, ash, and slag residues have a tendency to collect and build up on the ribbed inner surface of the tubular liner.

As the soot, ash and slag build up on the inner surface of the tubular liner the heat transfer capabilities of the liner decreases. This decrease in thermal transfer results in the production of less steam and also the failure to adequately cool the coat syngas to a workable temperature.

Since it is extremely difficult and costly to shut down the boiler and have men enter the vessel to scrape the surface of the tubular liner to remove the residue build-up, various types of cleaning apparatus were devised to remove the residue build-up. Some of these apparatus are incapable of use in high pressure boilers and can only be operated when the boiler is not in use. Thus, although such devices eliminated the need to manually scrape the inner surfaces they still required a costly shutdown of the boiler to clean the liner. Other devices capable of cleaning the liner while the high pressure boiler is in use fail to adequately protect the sprayheads from the thermal shock that occurs when the cleaning medium comes into contact with the hot sprayhead. The few devices that do provide some degree of thermal protection for the sprayhead to keep the temperature differential between the cooling medium and the sprayhead at a minimum, result in a system whereby the thermal protection for the sprayheads cannot be automatically cleaned. Consequently, even with these automatic and semiautomatic cleaners, much time and effort can still be wasted either repairing the sprayheads or cleaning the surfaces of the thermal protection.

SUMMARY OF THE INVENTION

The present invention pertains to a self-cleaning liner for boilers. The self-cleaning liner is of the type that employs a thermal shock resistant sprayhead assembly having thermal protection comprised of a waterwall and a refractory material; is operable while a high pressure boiler is in use; and, can keep the entire surface of the liner clean.

The sprayhead assembly is constructed to withstand the high temperature variations encountered between the sprayhead and the blowing medium. One of the features enabling the sprayhead assembly to withstand these temperature variations is the incorporation of a thermal sleeve that fits entirely inside the body of the sprayhead assembly. The thermal sleeve forms a double wall preventing the relatively cold blowing medium from coming in direct contact with the hot sprayhead assembly and is totally independent of the body allowing for differential expansion between the body and the thermal sleeve.

To further minimize thermal shock, a waterwall, which is basically a set of tubes that form a bump in the otherwise cylindrical tubular liner, is employed to thermally protect the sprayhead assembly. This thermal shielding decreases the amount of heat the sprayhead assembly is exposed to, keeping it cooler and thereby decreasing the temperature differential between the sprayhead assembly and the cleaning medium. A suitable refractory material may also be placed around the sprayhead assembly behind the waterwall to help keep the temperature of the sprayhead assembly at a minimum. The waterwall and the refractory material combine to thermally protect the sprayhead assembly from the harsh thermal environment of the boiler.

As a result of the unique tubular configuration of the waterwall and the thermal shock-resistant sprayhead assembly the disclosed invention minimizes thermal shock on the sprayhead assembly, increasing the life of the sprayhead assembly while still allowing the entire inner surface of the liner to be cleaned while the boiler is in use. Accordingly, it is an object of the present invention to provide a self-cleaning liner for use in high pressure boilers that comprises a sprayhead assembly protected from high temperatures, minimizing thermal shock of the sprayhead assembly, is thermal shock resistant and still allows for complete and automatic cleaning of the entire inner surface of the liner. Other and further objects and advantages will appear hereinafter.

DETAILED DESCRIPTION OF THE PREFERRED EMBODIMENT

Figure 1:
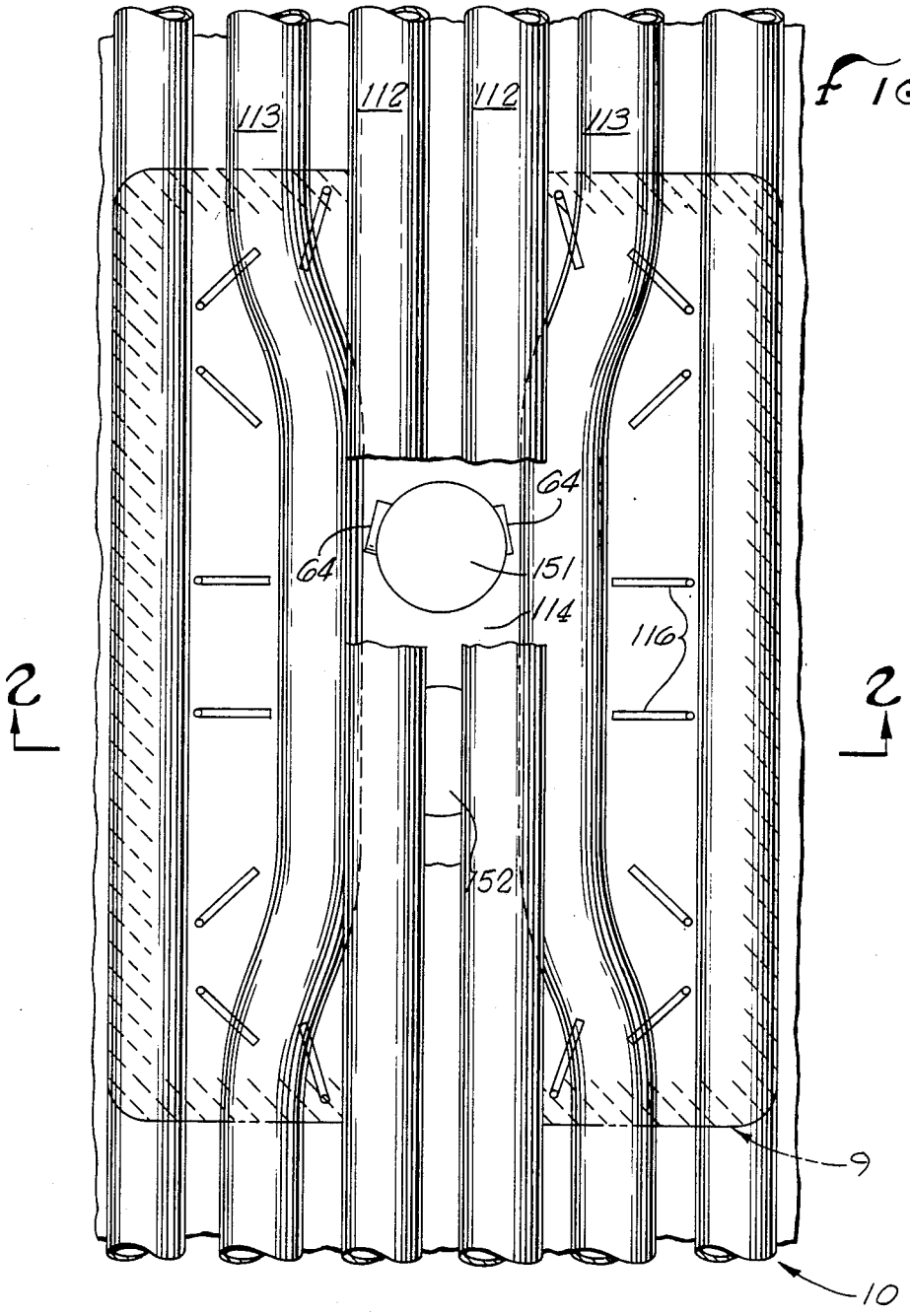
FIG. 1 is a schematic view of a section of the self-cleaning liner of the present invention showing two sprayhead assemblies and the perimeter of the refractory material.

With reference to FIGS. 1 through 4, a portion of a self-cleaning liner is disclosed. FIG. 1 shows a section of the self-cleaning liner having an upper sprayhead assembly 151 and a lower sprayhead assembly 152 with the refractory material illustrated in phantom. The refractory material perimeter is shown, generally designated as 9. The self-cleaning liner is shown constructed such that there are web members between each of the individual tubes that make up the tubular liner 10. Although the preferred embodiment utilizes an upper and a lower sprayhead assembly, 151 and 152, any number of sprayhead assemblies, all constructed in the manner described below, may be utilized.

Figure 3:
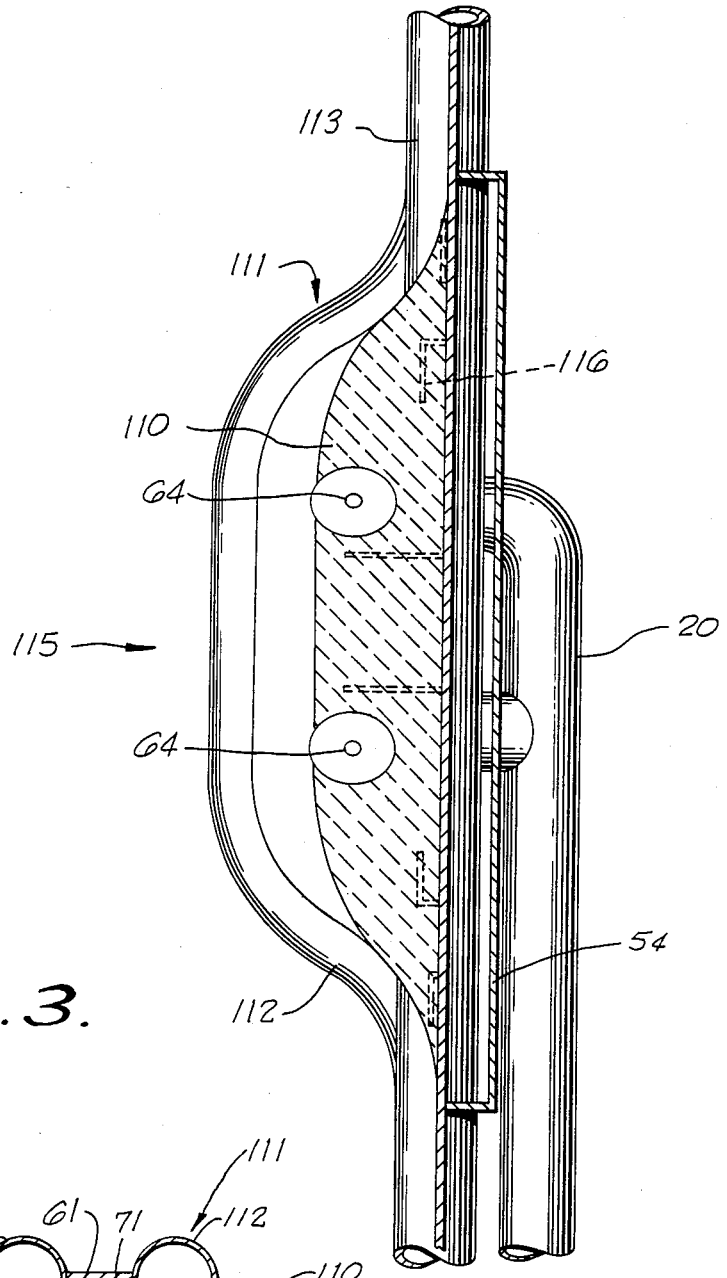
FIG. 3 is a sectional view taken along plane 3—3 of FIG. 2.
Figure 2:
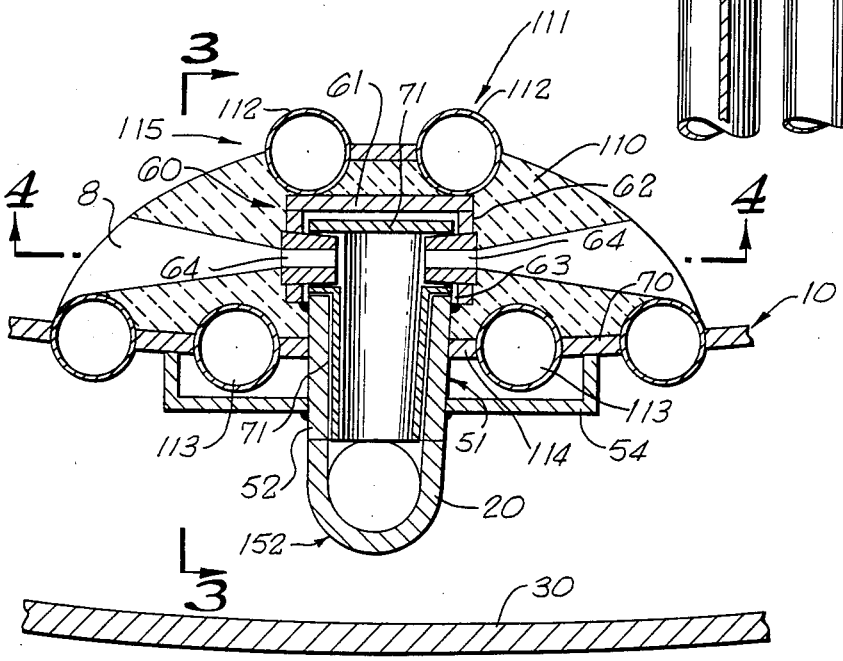
FIG. 2 is a sectional view taken along plane 2—2 of FIG. 1.

In FIG. 2, a waterwall 111, is shown, formed by bending a first set of tubes consisting of two of the tubular liner tubes 112 such that they form a bump, generally designated 115, in the otherwise cylindrical tubular liner 10. This is accomplished by making two "S" type bends in the liner tubes 112, one at the upper end of the bump 115 and one at the lower end of the bump 115. This configuration creates a cavity between the waterwall 111 and the tubular liner 10. A second set of tubes consisting of two additional tubular liner tubes 113, directly adjacent the two liner tubes 112 that form the waterwall 111, are also formed in a double "S" manner. As shown in FIG. 2 and FIG. 3 the two additional liner tubes 113 maintain the generally cylindrical shape of the tubular liner 10 unlike the two liner tubes 112 that form the bump 115.

FIG. 2 shows the lower sprayhead assembly 152, protruding into the cavity created by the formation of the liner tubes 112. The supply header 20 is shown located between the tubular liner 10 and the outer wall 30 of the high pressure boiler. In some applications it may be preferable to place the supply header 20 outside of the high pressure boiler such that the outer wall 30 is between the tubular liner 10 and the supply header 20.

The lower sprayhead assembly 152, as with the upper sprayhead assembly 151, has a body 51 connected to the supply header 20. The body 51, although shown round, may be of any convenient shape. The body 51 is comprised of a tube 52 and an end cap, generally designated 60. The end cap 60 is comprised of an end plate 61 and a cylinder 62. The first end of the tube 52 is attached to the cylinder 62 with a lip 63. The second end of the tube 52 is sealably attached to the supply header 20. The body 51 is mounted to the tubular liner 10 through the means of a support member 54. Suitable web members 114 are welded between the tubular liner 10 and the body 51 to form a gas tight seal.

Figure 4:
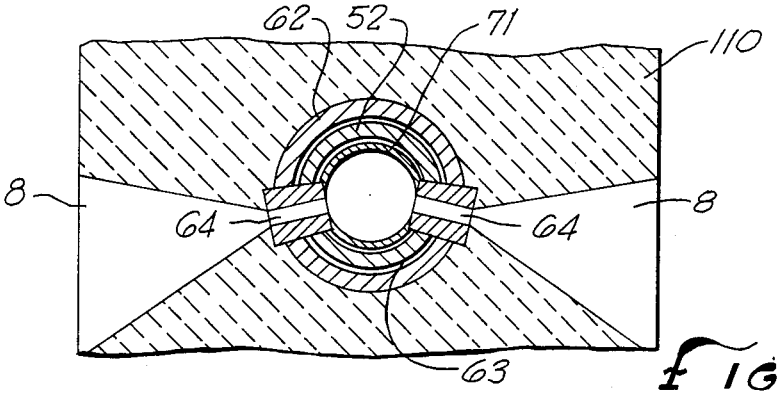
FIG. 4 is a sectional view taken along plane 4—4 of FIG. 2.

As shown in FIG. 2 and FIG. 4, a thermal sleeve 71 fits entirely within the lower sprayhead assembly 152. The thermal sleeve 71 is completely independent of the body 51, creates a double wall, and allows for differential expansion of the thermal sleeve 71 and the body 51. The thermal sleeve 71 in the preferred embodiment is made of metal but may be made of any suitable material.

Two nozzles 64 are attached to the cylinder 62. These nozzles 64 are seal welded to the cylinder 62. The nozzles 64 extend through but are not attached to the thermal sleeve 71. Clearance is provided between the nozzles 64 and the thermal sleeve 71 allowing the nozzles 64 to expand and contract with the body 51 independently of the thermal sleeve 71. The preferred embodiment shows two nozzles 64 attached to the cylinder 62. The nozzles 64 are oriented such that the nozzles 64 of the upper sprayhead assembly 151 and the lower sprayhead assembly 152 spray the entire surface of the liner on each side of the waterwall 111. In some applications it may be desirable to have only one, or as many nozzles 64 emanating from one sprayhead assembly as desired.

Figure 5:
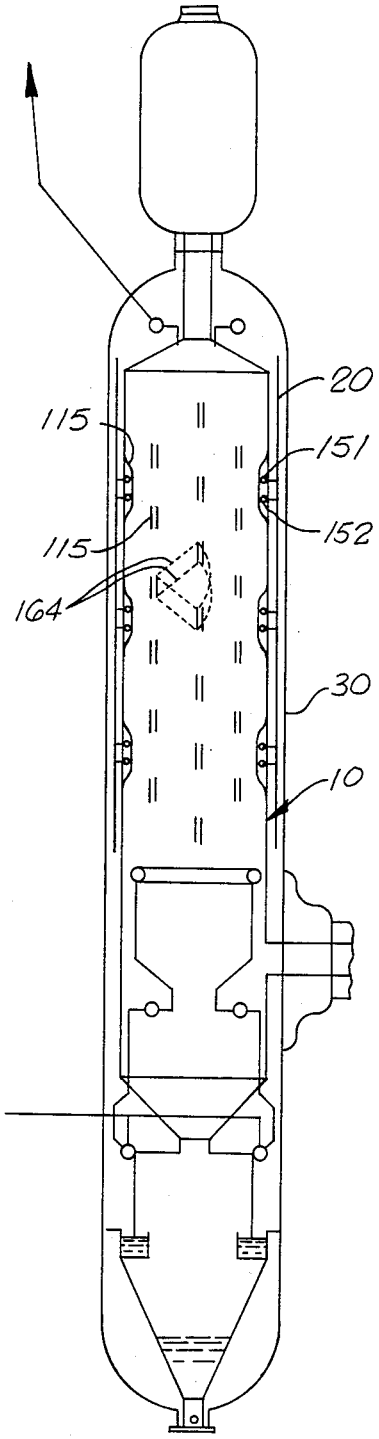
FIG. 5 shows a high pressure boiler with the self-cleaning liner in place.

With proper orientation of the nozzles and locations of the sprayhead assemblies, the entire inner surface can be kept clean. In FIG. 5, the sprayhead assemblies are shown arranged such that the spray 164 from one of the sprayhead assemblies keeps the waterwall 111 that protects another sprayhead assembly, free from soot, ash and slag. One such possible arrangement is to space the sprayhead assemblies circumferentially at 20 to 30 degrees of arc and 3 to 4 feet apart vertically. Thus, the waterwalls 111 which provide the thermal protection for the sprayhead assemblies are automatically cleaned.

A refractory material 110, shown best in FIG. 2, may be placed in the cavity between the waterwall 111 and the tubular liner 10, completely surrounding the upper sprayhead assembly 151 and the lower sprayhead assembly 152. The refractory material 110 is initially in a generally plastic state such that the refractory material may be installed in the field and formed to fit the contours of the tubular liner 10 and the sprayhead assemblies, 151 and 152. Suitable conical shaped passageways 8 are formed in the refractory material 110 allowing the cleaning medium to exit the nozzles 64.

A securing means is used for securing the refractory material 110 to the tubular liner 10. A suitable securing means is through the use of angled rods 116. The angled rods 116 are welded to the liner webs and project into the refractory material 110.

Thus, a self-cleaning liner having a design that minimizes thermal shock, is thermal shock resistant and is capable of cleaning the entire inner surface of a tubular liner in a high pressure boiler is disclosed. While embodiments and applications of this invention have been shown and described, it would be apparent to those skilled in the art that many more modifications are possible without departing from the inventive concepts described. The invention, therefore, is not to be restricted except in the spirit of the appended claims.

What is claimed is:

1. A self-cleaning liner comprising a tubular liner having tubular liner tubes for transporting a heat exchange medium which are joined together to form a continuous surface and a sprayhead assembly, wherein one of said tubular liner tubes is bent to form a bump in said tubular liner, said bump extending into the interior of the area defined by said tubular liner tubes creating a cavity between itself and said tubular liner; and said sprayhead assembly is disposed within said cavity directly behind said bump, oriented such that it can spray a fluid on the interior of said continuous surface formed by said tubular liner tubes.

2. A self-cleaning liner of claim 1 further comprising a refractory material wherein said refractory material fills said cavity such that said refractory material surrounds said sprayhead assembly and said refractory material is secured to said tubular liner by a securing means.

3. A self cleaning liner of claim 1 wherein said sprayhead assembly comprises; a body; a thermal sleeve inserted inside said body; and at least one nozzle extending through said body and sealably attached thereto.

4. A self-cleaning liner comprising a tubular liner having tubular liner tubes for transporting a heat exchange medium which are joined together to form a continuous surface; at least one sprayhead assembly; a waterwall; and, a refractory material; wherein said waterwall comprises two of said tubular liner tubes bent to form a bump in said tubular liner, said bump extending into the interior of the area defined by said tubular liner tubes creating a cavity between said waterwall and said tubular liner; said sprayhead assembly protruding into the cavity directly behind said waterwall; said refractory material filling the cavity between said waterwall and said tubular liner surrounding said sprayhead assembly and secured to said tubular liner through a securing means; and said sprayhead assembly comprises a body; a thermal sleeve inserted inside said body; at least one nozzle extending through said body and sealably attached thereto; a support member for mounting said body to said tubular liner, and a web member attached to said body and said tubular liner, creating a gastight seal.

5. A self-cleaning liner of claim 4 wherein said body comprises a tube and an end cap, said tube having a first and a second end, said end cap attached to said first end of said tube; and said second end of said tube is attached to a supply header.

6. A self-cleaning liner of claim 4, wherein said securing means comprises at least one angled rod permanently attached to said tubular liner.

7. A self-cleaning liner of claim 4 wherein said refractory material is initially in a plastic state.

8. A self-cleaning liner comprising a tubular liner comprised of tubular liner tubes; an upper sprayhead assembly and a lower sprayhead assembly; a waterwall; and, a refractory material; wherein said waterwall comprises a first set of tubular liner tubes including two of said tubular liner tubes bent to form a bump in said tubular liner creating a cavity between said first set of liner tubes and said tubular liner; said upper and lower sprayhead assemblies protrude into the cavity directly behind said waterwall; said refractory material is initially in a plastic state and fills the cavity between said waterwall and said tubular liner, surrounds said upper and lower sprayhead assemblies, and is secured to said tubular liner by at least one angled rod; said upper and lower sprayhead assemblies comprising a body; a thermal sleeve inserted inside said body; at least one nozzle extending through said body and sealably attached thereto; a support member for mounting said body to said tubular liner, wherein said body comprises a tube and an end cap, said tube having a first and a second end, said end cap attached to said first end of said tube; and said second end of said tube is attached to a supply header and a web member is attached to said body and the tubular liner, creating a gastight seal.

9. A self-cleaning liner of claim 8 wherein said upper sprayhead and said lower sprayhead each comprise two nozzles.

10. A self-cleaning liner of claim 9 further comprising a second set of tubular liner tubes including at least one tubular liner tube adjacent said first set of liner tubes; wherein said second set of liner tubes is formed in an S-shape to partially fill the area directly behind said waterwall.

11. A self-cleaning liner of claim 1 wherein a plurality of sprayhead assemblies are arranged in said tubular liner such that the spray from one said sprayhead assembly sprays said bump of another of said sprayhead assemblies such that the entire inner surface of said tubular liner is sprayed.

12. A self-cleaning liner of claim 4 wherein a plurality of sprayhead assemblies are arranged in said tubular liner such that the spray from one said sprayhead assembly sprays said waterwall of another of said sprayhead assemblies such that the entire inner surface of said tubular liner is sprayed.

13. A self-cleaning liner of claim 10 wherein a plurality of sprayhead assemblies are arranged in said tubular liner such that the spray from one said sprayhead assembly sprays said waterwall of another of said sprayhead assemblies such that the entire inner surface of said tubular liner is sprayed.

* * * * *

UNITED STATES PATENT AND TRADEMARK OFFICE

CERTIFICATE OF CORRECTION

PATENT NO. : 4,545,330

DATED : October 8, 1985

INVENTOR(S) : Russell B. Covell, Andrew F. Kwasnik

It is certified that error appears in the above-identified patent and that said Letters Patent are hereby corrected as shown below:

At column 1, line 32, delete "coat" and insert therefor -- coal --.

Signed and Sealed this

*Eighth* Day of *April 1986*

[SEAL]

*Attest:*

DONALD J. QUIGG

*Attesting Officer*

*Commissioner of Patents and Trademarks*